US011359403B2

(12) United States Patent
Hofmann

(10) Patent No.: US 11,359,403 B2
(45) Date of Patent: Jun. 14, 2022

(54) LOCKING BOLT

(71) Applicant: Otto Ganter GmbH & Co. KG Normteilefabrik, Furtwangen (DE)

(72) Inventor: Thilo Hofmann, Furtwangen (DE)

(73) Assignee: OTTO GANTER GMBH & CO. KG NORMTEILEFABRIK, Furtwangen (DE)

( * ) Notice: Subject to any disclaimer, the term of this patent is extended or adjusted under 35 U.S.C. 154(b) by 522 days.

(21) Appl. No.: 16/250,382

(22) Filed: Jan. 17, 2019

(65) Prior Publication Data

US 2019/0257114 A1 Aug. 22, 2019

(30) Foreign Application Priority Data

Feb. 20, 2018 (DE) ..... 202018100923.0

(51) Int. Cl.

| | |
|---|---|
| ***E05B 15/00*** | (2006.01) |
| ***E05C 1/08*** | (2006.01) |
| ***E05B 47/00*** | (2006.01) |
| ***E05C 1/04*** | (2006.01) |
| ***E05C 5/00*** | (2006.01) |

(Continued)

(52) U.S. Cl.

CPC ..... *E05B 15/0073* (2013.01); *E05B 47/0038* (2013.01); *E05C 1/04* (2013.01); *E05C 1/085* (2013.01); *E05C 5/00* (2013.01); *E05B 15/0053* (2013.01); *E05B 15/102* (2013.01);

(Continued)

(58) Field of Classification Search

CPC ..... E05B 15/0073; E05B 47/0038; E05B 15/0053; E05B 15/102; E05B 2015/0413; E05B 2047/0069; E05B 2047/0067; E05B 81/64; E05B 81/66; E05B 81/68; E05B 63/248; E05B 47/0046; E05B 63/0017; E05B 17/22; E05C 1/04; E05C 1/085; E05C 5/00; E05C 1/00; E05C 1/002; Y10T 292/096; Y10T 292/0969; Y10T 292/0997;

(Continued)

(56) References Cited

U.S. PATENT DOCUMENTS 5,308,973 A * 5/1994 Odoni ..... G01L 1/243 250/227.17
7,249,528 B2 * 7/2007 Inoue ..... B60B 27/0026 73/862.392

(Continued)

FOREIGN PATENT DOCUMENTS

CN 102155128 8/2011
CN 102155128 A * 8/2011

(Continued)

*Primary Examiner* — Kristina R Fulton
*Assistant Examiner* — Tal Saif
(74) *Attorney, Agent, or Firm* — Faegre Drinker Biddle & Reath LLP

(57) ABSTRACT

A manually operated locking bolt (1) having a cylindrical, sleeve-shaped bolt guide (3) and a bolt (2), which is mounted to be axially displaced in the bolt guide (3), and which has a locking end (15) and an actuating end (31), wherein the bolt (2) is mounted to be axially displaced between a first axial end position or a second axial end position within the bolt guide (3) and can be locked, wherein at least one sensor (27) is fastened to the bolt guide (3), which sensor detects the two axial end positions of the bolt (2) as a measured variable and generates therefrom a further processable electrical signal.

18 Claims, 5 Drawing Sheets

(51) Int. Cl.
*E05B 15/10* (2006.01)
*E05B 15/04* (2006.01)

(52) U.S. Cl.
CPC ..... *E05B 2015/0413* (2013.01); *E05B 2047/0069* (2013.01)

(58) Field of Classification Search
CPC ..... Y10T 292/1013; Y10T 292/1022; Y10T 292/1023; Y10T 292/1024; F16P 3/08
See application file for complete search history.

(56) References Cited

U.S. PATENT DOCUMENTS

2012/0299314 A1* 11/2012 Jiang ..... E05B 45/083 292/137
2014/0345110 A1* 11/2014 Schmidt ..... F16B 13/004 29/450
2015/0061300 A1* 3/2015 Hudson ..... E05D 15/16 292/164
2017/0089458 A1 3/2017 Schirmer

FOREIGN PATENT DOCUMENTS

DE 4037077 5/1992
DE 102012201293 8/2013
DE 102012112610 6/2014
DE 102012112610 A1 * 6/2014 ..... E05B 15/0053
DE 102014107080 11/2015
DE 102015116841 A1 * 4/2017 ..... F16B 31/00
EP 2383409 A2 * 11/2011 ..... E05B 9/084
EP 2450509 5/2012
EP 2450509 A2 * 5/2012 ..... E05B 47/0004
GB 2318610 A * 4/1998 ..... E05B 81/64
WO 2003/0062571 7/2003
WO WO-2006133760 A1 * 12/2006 ..... B60R 25/02153
WO WO-2014016281 A1 * 1/2014 ..... E05B 41/00

* cited by examiner

LOCKING BOLT

CROSS-REFERENCE TO RELATED APPLICATION

The present application claims priority to DE 202018100923.0, filed Feb. 20, 2018, the entire disclosure of which is hereby expressly incorporated herein by reference.

BACKGROUND/SUMMARY

The subject matter of the disclosure is a locking bolt.

For example, DE 10 2012 112 610 A1 discloses a manually actuated locking bolt, which consists of a sleeve and a bolt mounted in the sleeve and which has a locking end and an actuating end, wherein the bolt is mounted to be axially displaced between a first axial end position and a second axial end position within the sleeve.

At least in an axial end position relative to the sleeve, the bolt can be locked with a latching mechanism or magnetically fixed temporarily or permanently with magnetic elements.

Furthermore, the locking bolt can have an automatic reset and thus have a basic position.

Whether the locking bolt is moved for actuation or for locking or unlocking by pressing or pulling the actuating element, for example a knob, depends on the installation location of the resetting element, for example a compression or tension spring.

A disadvantage of this locking bolt is that it is not possible to determine the position of the bolt without manually actuating or inspecting the locking bolt. When the locking bolt is used to fix a component, for example a flap at a machine housing, it is necessary to determine whether the locking bolt is in its axial locking position or whether it is released. This is the only way to ensure that the component is securely locked or unlocked.

However, with the locking bolts according to the prior art, it is only possible to detect the position of the locking bolt by means of haptic or visual perception.

Even if the bolt appears to be in its locking position or the view of the bolt is obscured by another component, it is not possible from a remote position to determine whether the locking bolt is really locked and fixed in its locking position. For example, the locking bolt could be released from its locked or unlocked position by vibration without noticing it.

Especially with safety-relevant queries on large systems, it is necessary to determine the exact position of the locking bolt at any time. It is therefore the objective of the present disclosure to further develop a locking bolt of the known type in such a way that it is possible to sense the position of the locking bolt even from a remote position of a user.

A feature of the present disclosure is that a locking bolt is used with a position sensing device which allows determining whether the locking bolt is engaged and/or disengaged or locked and/or unlocked. A sensor detects the front (locking position) or rear end position (unlocking position) or both positions of the bolt. For this purpose, at least one sensor is attached to the bolt guide, which detects the two axial end positions of the bolt as a measured variable and generates a hydraulic, pneumatic or preferably electrical signal that can be processed further.

For this purpose, a sensor is used, which detects the position of a bolt moving in a bolt guide and converts it into a measuring signal.

Such a sensor reacts either contact-free to approach, i.e. without any direct contact, or tactile by actuating one of the components moving toward each other.

The present disclosure claims the use of the following proximity sensors:

- Inductive sensors: these react to both ferromagnetic and non-magnetic metallic objects.
- Capacitive sensors: these react to both metallic and non-metallic materials. When an object approaches, the oscillation frequency of the sensor oscillating circuit changes.
- Magnetic sensors (for example, reed switches, reed contacts or Hall sensors):
  these react to a magnetic field.
- Pressure sensors: these react to pressure or mechanical stresses (for example, strain gauges or the like).
- Alternatively, it is also possible to use a mechanical or tactile limit switch, which delivers a signal that can be evaluated pneumatically, hydraulically or electronically.
- Alternatively, the position can be detected using RFID (Radio Frequency Identification) or NFC (Near Field Connection) technology, whereby the sensor is replaced by a transponder and the corresponding antenna is located in the operating knob of the moving bolt.

Subsequently, the disclosure is described using a magnetic sensor type that reacts to a magnetic field. In a first embodiment, a permanent magnet is attached to the moving part of the locking bolt, which is located at different distances from the respective sensor depending on the position of the locking bolt. A magnetic sensor has the advantage that it can also function under difficult conditions such as heat, dust and vibrations—and even through non-ferromagnetic objects.

In one embodiment, a magnet is integrated in or on the actuating element, which is used at the actuating end of the bolt to displace the bolt in the bolt guide. For example, such an actuating element can be designed in the form of an operating knob. However, the present disclosure is not limited to the design of an operating knob, also a lever or a locking bar or a T-handle or any other actuating element with or without handle forms a part of the present disclosure.

The magnet used can be integrated into the actuating element in a ringed-shaped fashion or even in the form of a segment. However, the present disclosure is not limited to such uses. The use of a semi-circular magnet or a magnet arranged at a specific point forms a part of the present disclosure.

For example, the magnet used can be a neodymium magnet or a ferrite magnet or is made of another magnetic material. In a further embodiment, the actuating element is made of an at least partially magnetic material. For example, the actuating element can be manufactured in a sintering process in which fine-grained ceramic or metallic materials are heated and bonded with magnetic materials under increased pressure. In addition, a magnetic material can also be used in an injection molding production process to manufacture the operating knob from plastic or elastomer.

However, subsequently an embodiment of the disclosure is described in which the locking bolt has an annular magnet in its knob-like actuating element, which acts axially or diametrically magnetized in the direction of the bolt guide. When the operating knob is actuated to move the bolt axially in the bolt guide, the annular magnet is moved in relation to a sensor mounted in the bolt guide area. Such a sensor is mounted in the area of the contact surface on which the underside of the operating knob rests in the locking position of the locking bolt. For this purpose, the sensor is embedded in a sensor holder, which surrounds the bolt guide at least partially in ring-shaped fashion. When the annular magnet field is detected by the sensor, the sensor emits a signal upon reaching a threshold value, which indicates the locking position of the bolt.

The distance or approach of the annular magnet to the sensor can be detected by the sensor.

The sensor used can be programmed during the production of the component requiring, for example, that a threshold value of 2-6 milliteslas is exceeded, above which the sensor emits a signal.

The sensor is fastened in detachable or non-detachable fashion, in form, friction or force-fitting manner on the bolt guide and can be snapped on or clipped on, clamped, plugged on, screwed in or fastened to the component with an additional sensor holder.

In a further embodiment of the disclosure, it has been decided not to use a sensor holder so that the sensor is located directly in the jacket of the bolt guide. For this purpose, a mounting hole or the like is drilled into the bolt guide, into which the sensor can be inserted to determine the position of the bolt.

For example, the mounting for the sensor can also be cast directly into the component.

The inventive apparatus is suitable for bolts with or without locking catch. A locking catch has the purpose of fixing the operating knob in a specific end position. When the bolt is pulled out of the bolt guide, the operating knob can lie with its underside on the end face of a sleeve-shaped locking catch. For this purpose, the operating knob has at least one shoulder on its underside, which interrupts section by section a cylindrical receiving space inside the hollow operating knob. The holding space has the purpose of holding the sleeve-shaped locking catch when the underside of the operating knob is located on the contact surface and the locking bolt is in the locking position.

The position of the operating knob, in which the shoulder rests on the sleeve-shaped locking catch, can only be achieved by turning the head. The shoulder is turned until it reaches an axial notch in the wall of the sleeve-shaped locking catch and is held in this notch.

In this position the locking bolt can remain temporarily or permanently in the achieved end position. It is not possible to change the position in an axial direction.

When the shoulder is turned again until it reaches an axial slot in the wall of the sleeve-shaped locking catch and is accommodated in this slot, the head with the shoulder can be moved again in the direction of the front contact surface of the bolt guide.

In a further embodiment of the disclosure, a sensor is located on the front end area of the sleeve-shaped locking catch and a magnet in the shoulder area to detect whether the shoulder is resting on it in order to determine the end position or locking position of the locking bolt.

In a further embodiment of the disclosure, a position sensor/or rotation sensor in the area of the locking catch is used, which determines the rotary position of the operating knob. For example, a query can only occur during a 90° rotation in order to determine how far the operating knob must be turned until the shoulder reaches the slot.

The reverse operating principle of the inventive locking bolt is also possible, which requires an actuation by pressing instead of pulling. Preferably, a spring element that pushes the bolt into an axial end position is provided.

The subject-matter of the present disclosure results not only from the subject-matter of the individual patent claims, but also from a combination of the individual patent claims.

All the information and characteristics disclosed in the documents, including the abstract, in particular the spatial design depicted in the drawings form a part of the disclosure.

The fact that individual objects are depicted to be "essential" or "important" does not mean that these objects must necessarily form the subject-matter of an independent claim. This is determined solely by the respective valid version of the independent claim to be protected.

BRIEF DESCRIPTION OF THE DRAWINGS

Subsequently, the disclosure is described in more detail using drawings which that represent multiple routes of execution. In this context, the drawings and their descriptions show further characteristics and advantages of embodiments of the disclosure.

It is shown.

DETAILED DESCRIPTION

Figure 1:
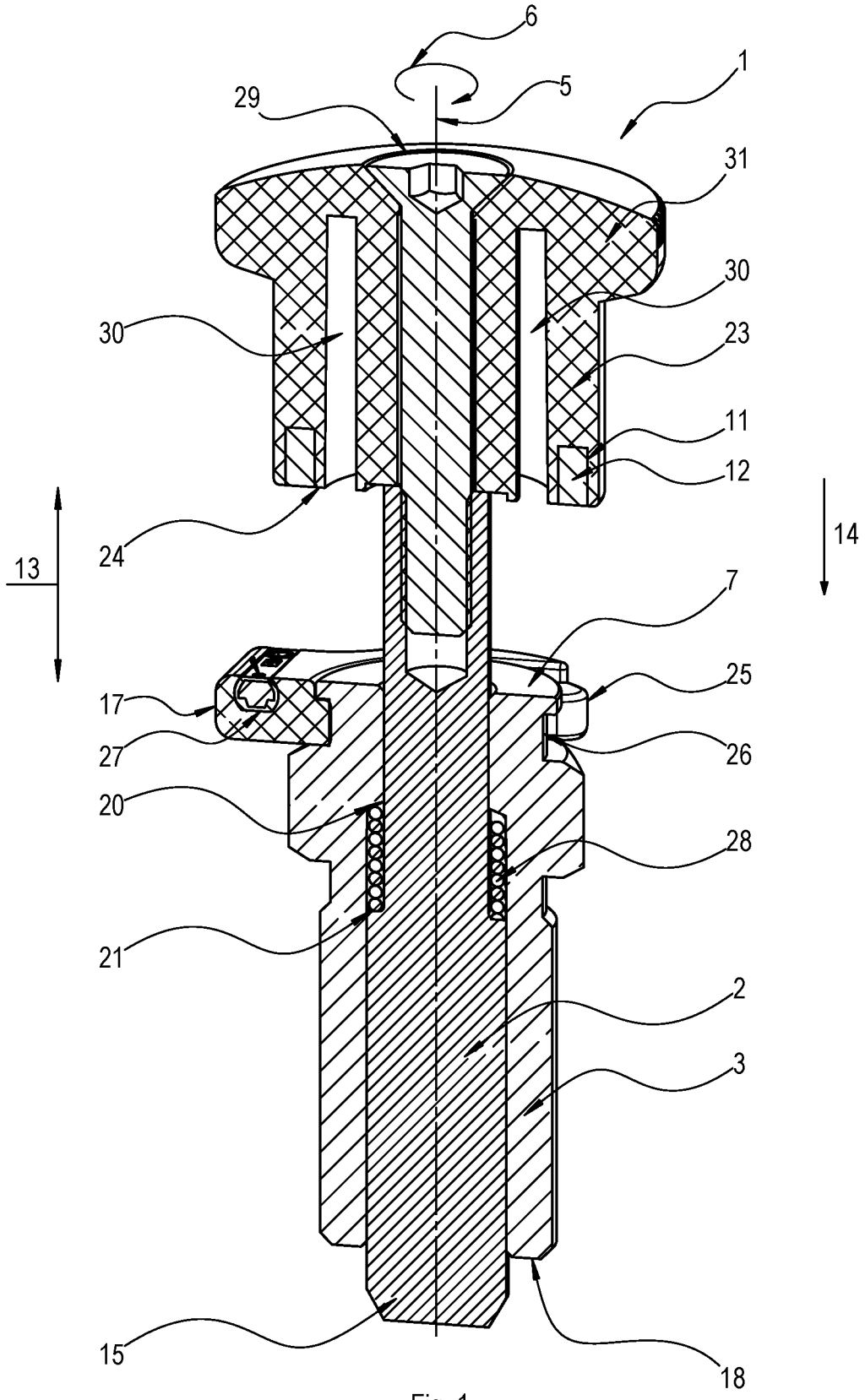
FIG. 1: a perspective sectional view of a locking bolt (1st embodiment)

FIG. 1 shows a locking bolt 1 consisting of a bolt 2, which is guided in axial direction in a bolt guide 3. For this purpose, the bolt 2 is moved along an axis 5 and can also be rotated about this axis in the direction of rotation 6.

The bolt has a locking end 15 and an actuating end 31, which is provided in FIG. 1 with an operating knob 23. However, the present disclosure is not limited to the design of an operating knob; a lever or a locking bar or a T-handle or any other actuating element is also claimed with the present disclosure.

Via the head 23, the bolt 2 can be moved in axial direction along the axis 5 in the bolt guide 3 and can also be rotated about this axis in the direction of rotation 6.

The operating knob 23 has an underside 24, which is located opposite a contact surface 7 of the end face of the bolt guide 3. On the underside 24, the operating knob 23 has an annular groove 11 in which an annular magnet 12 is accommodated.

In the example shown in FIG. 1, the operating knob 23 is located at a distance 13 from the contact surface 7 of the bolt guide 3. The spring 28, which rests on the ring shoulder 21 of the bolt 2, is compressed between the ring shoulder and a ledge 20 inside the bolt guide 3.

Below the contact surface 7, the bolt guide 3 has a groove 26, in which a sensor element 17 is inserted. The sensor element 17 consists of a sensor holder 25 and at least one sensor 27. For example, the sensor 27 can be injected into a plastic holder.

In the example shown in FIG. 1, the sensor element 17 is held in the groove 26 due to the effect of a clamping force.

The clamping force is achieved by the horseshoe-shaped design of the sensor element 17, wherein the sensor element 17 is pushed onto the bolt guide in the area of the annular groove 26. However, the disclosure is not limited to the horseshoe U-shape of the sensor holder described, it is also possible to use an enclosure in the shape of a circular segment.

In addition to the option of injecting the sensor 17 into the sensor holder 25, the sensor 17 can also be inserted in the sensor holder 25, as shown in the embodiment shown in FIG. 1. For this purpose, the sensor holder 25 has a mounting hole in which the sensor 27 can be inserted. For example, the fixation can also be implemented by axially inserting or mounting or closing by means of a cable tie in a detachable or permanently latching manner.

Preferably the sensor holder 25 is made of plastic material.

In the example shown in FIG. 1, the sensor is inserted in a decentralized manner in the sensor holder.

When the operating knob 23 with the accommodated magnet 12 is now moved in arrow direction 14 in the direction of the contact surface 7, the sensor 27 detects this approach as a measured variable and forms an electrical, pneumatic or hydraulic signal, which can be processed further and subsequently evaluated. As a result, it is especially possible to determine and monitor the contact of the operating knob 23 and its underside 24 on the contact surface 7.

Figure 2:
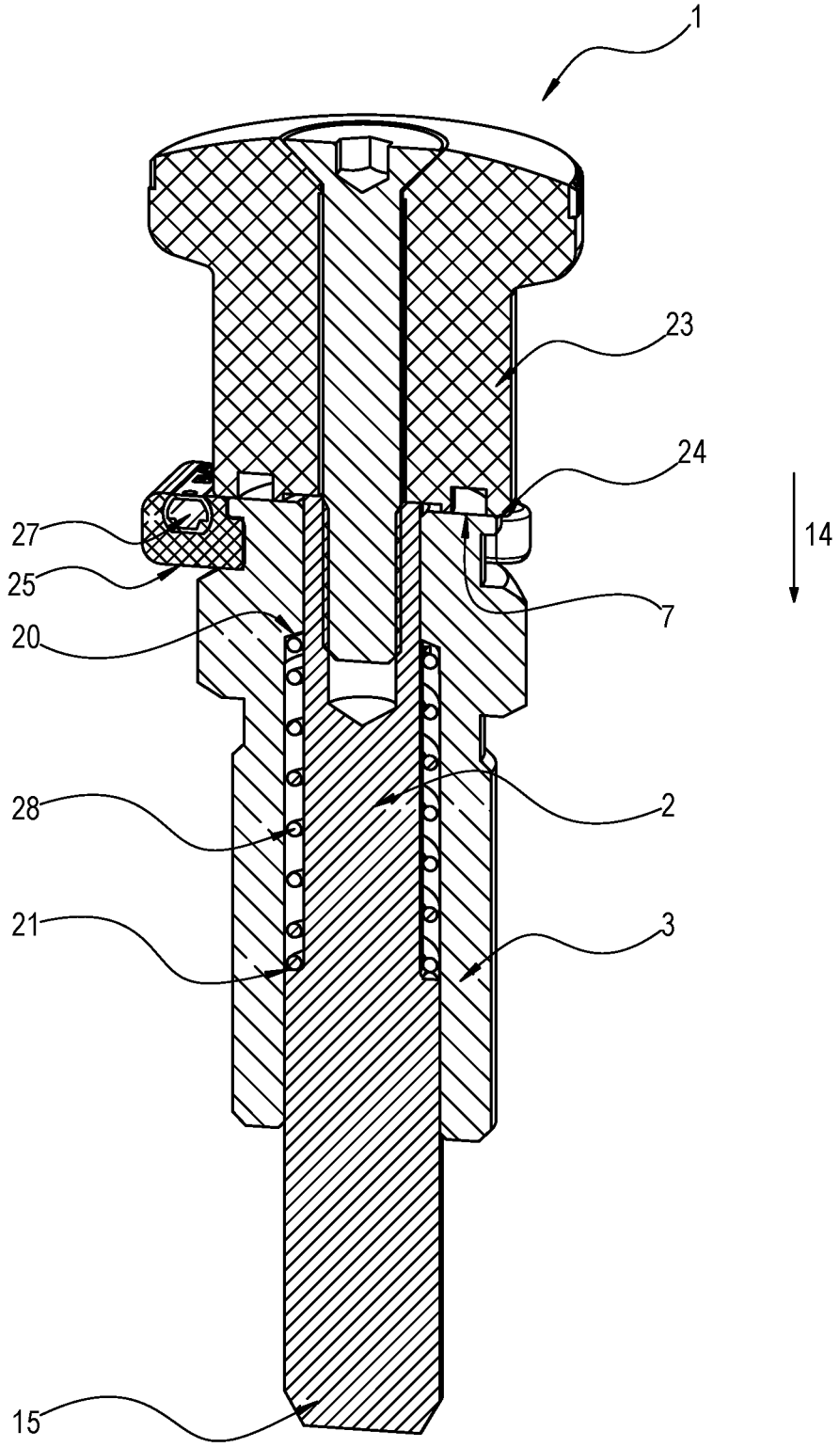
FIG. 2: a perspective sectional view of a locking bolt (2nd embodiment)

FIG. 2 shows the unlocking position, wherein the bolt 2 guided in the bolt guide 3 is completely inserted in the bolt guide and the locking end 15 protrudes to a maximum extent from the open end face. From this position the operating knob 23 or actuating element can be pulled, wherein the bolt 2 is pulled into the bolt guide 3 in such a way that the locking end 15 is retracted in the open end face 18 of the bolt guide and thus assumes an unlocking position. The spring 28, which rests on the ring shoulder 21 of the bolt 2, is compressed between the ring shoulder and a ledge 20 inside the bolt guide 3. In this position, the operating knob 23 and its underside 24 lie at a distance from the contact surface 7 of the bolt guide 3. The sensor 27 detects the position of the operating knob 23 as absent and accordingly does not transmit a signal.

Compared to FIG. 1, FIG. 2 differs in the position shown and also in the fact that there is no single magnet in the operating knob 23. In the embodiment shown in FIG. 2, the entire knob 23 is designed in the form of a magnetic body.

The operating knob 23, which in this embodiment does not have an annular magnet on its underside, consists at least partially of a magnetic material. For example, such a magnetic material can be used in the injection molding of the production process of the operating knob 23. The knob can also be manufactured in a sintering process, in which the magnetic particles are press-fitted.

Figure 3:
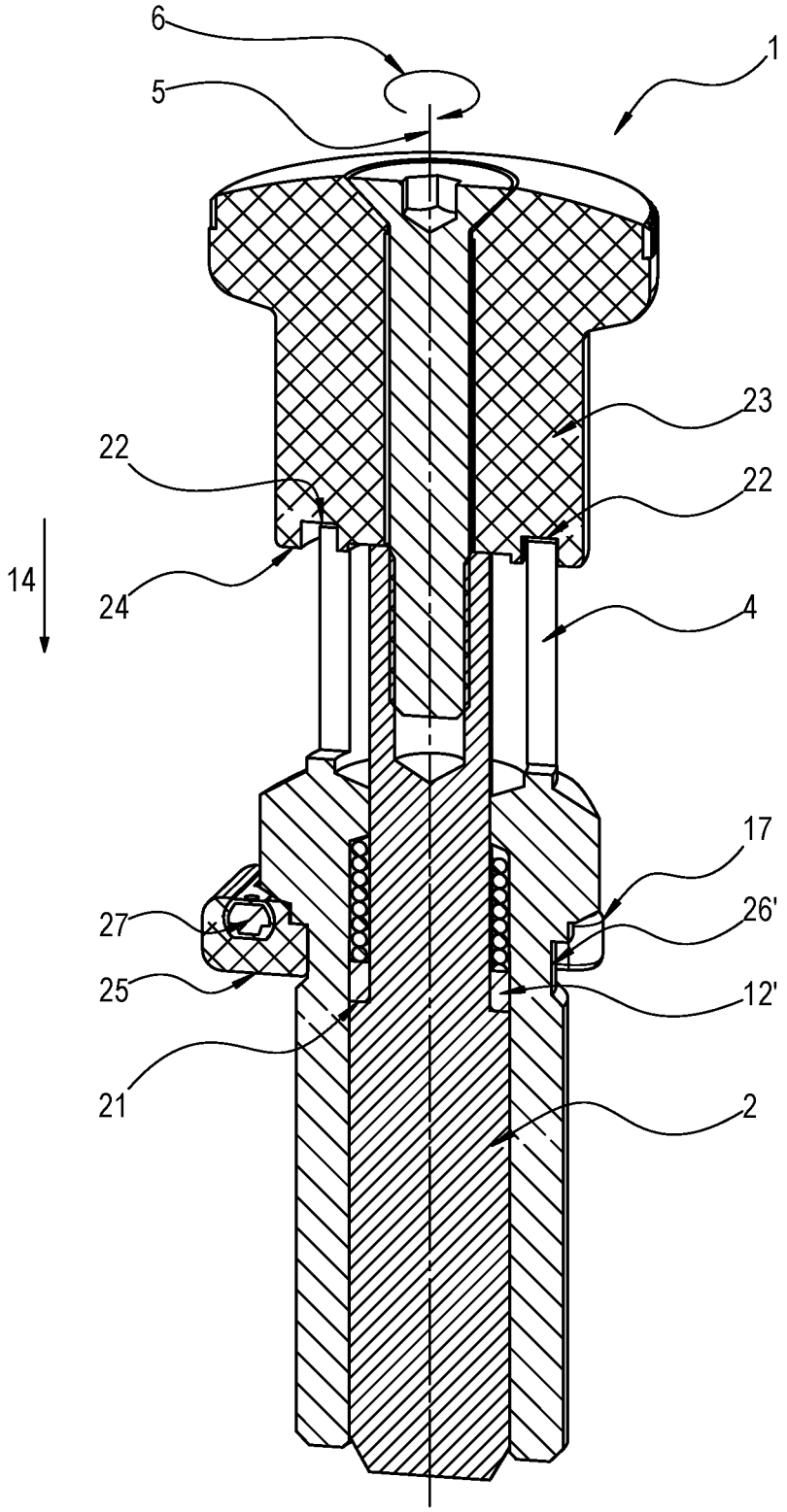
FIG. 3: a perspective sectional view of a locking bolt (3rd embodiment)

In the embodiment shown in FIG. 3, the sensor element 17 is located in the groove 26', which is arranged in the central area of the sleeve-like bolt guide 3. The magnet 12' for determining the position of the bolt 2 is no longer located in the knob 23 but is mounted directly on the outer circumference of the bolt 2, inside the bolt guide 3.

The magnet 12' rests on a ring shoulder 21 of the bolt 2 and can therefore be moved together with the bolt 2 in the axial direction inside the bolt guide 3.

If now the magnet 12' is moved to the sensor 27, the sensor detects the position of the magnet and can determine the current or unlocked or retracted position of the bolt 2.

The locking bolt 1 has a locking catch 4 in order to temporarily or permanently fix the operating knob 23 in a specific end position (unlocking position).

When the bolt 2 is pulled out of the bolt guide 3 against the direction of the arrow 14, the knob 23 and its underside 24 can lie on the end face of the sleeve-shaped locking catch 4. For this purpose, the knob 23 has at least one shoulder 22, which interrupts section by section a cylindrical receiving space 30. The receiving space 30 is used to accommodate the sleeve-shaped locking catch 4 when the underside of the operating knob 23 is located on the contact surface 7 as shown in FIG. 2.

The shown position of the actuating knob 23, in which the shoulder 22 rests on the sleeve-shaped detent lock, can only be released by moving the head 23 along axis 5 in the opposite direction of the arrow 14. As soon as the shoulder 22 is no longer in contact with the end face of the catch 4, the knob 23 can be turned around the axis 5 until the shoulder 22 reaches a slot in the wall of the sleeve-shaped catch 4. The slot accommodates the shoulder 22, while the catch can be inserted into the receiving space 30.

As a result, the knob 23 can again be moved in arrow direction 14 in the direction of the front contact surface 7 of the bolt guide 3.

In locking bolts, which are brought into locking position by pressing the actuating element 23 of the bolt 2, a locking catch can be attained, for example by means of a J-shaped cam track. For this purpose, the actuating element 23, which in this case has a cam or nose in its interior, is brought into stop position by turning about the axis 5 following the axial stroke in direction 14, so that the stop position is maintained permanently or temporarily, if necessary, against the reset force of the spring.

Figure 4B:
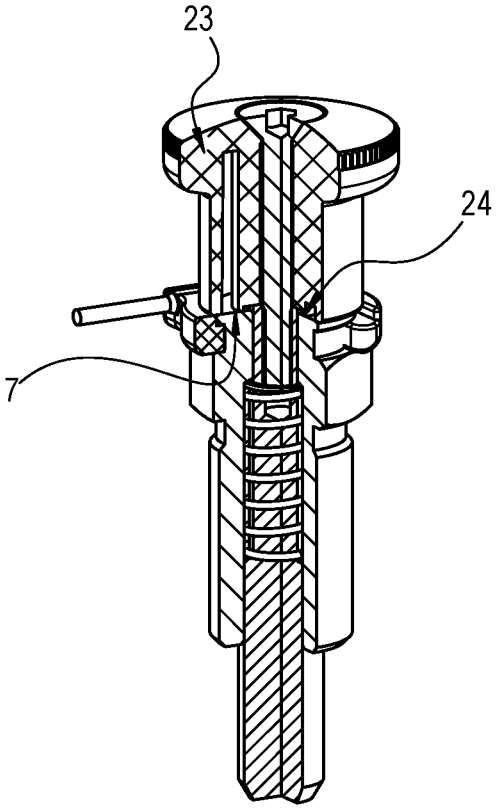
FIGS. 4*a*, 4*b*: a perspective sectional view of a locking bolt (1st embodiment)
Figure 4A:
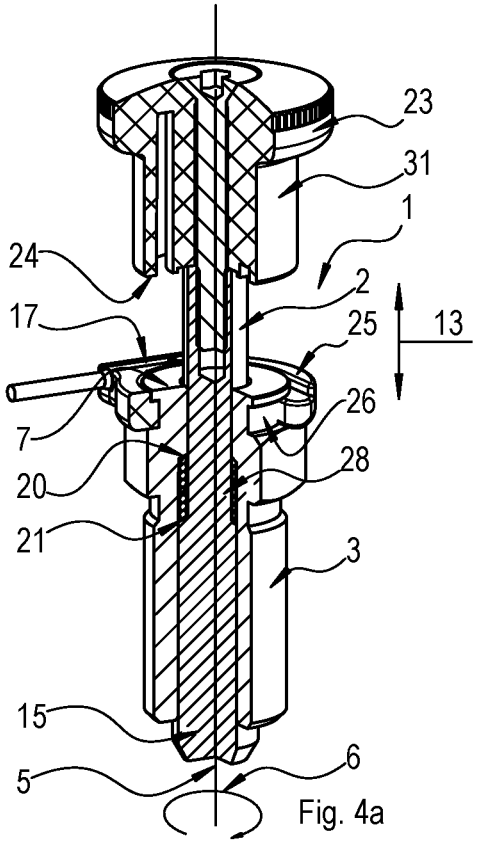

FIGS. 4*a* and 4*b* show the locking bolt 1 without locking catch, wherein a query is made in the locked condition. The locking bolt 1 consists of the bolt 2, which is guided in axial direction by the bolt guide 3. The bolt 2 is moved along the axis 5 and can also be rotated about this axis in the direction of rotation 6.

In FIGS. 4*a* and 4*b*, the bolt has the locking end 15 and the actuating end 31, which is provided with an operating knob 23.

Via the head 23, the bolt 2 can be moved axially along the axis 5 in the bolt guide 3.

The operating knob 23 has an underside 24 which is located opposite the contact surface 7 of the end face of the bolt guide 3.

On the underside 24, the operating knob 23 has an annular groove in which a ring magnet can be accommodated.

In the example shown in FIG. 4*a*, the underside 24 of the operating knob 23 is located at a distance 13 from the contact surface 7 of the bolt guide 3. The spring 28, which rests on the ring shoulder 21 of the bolt 2, is compressed between the ring shoulder and a ledge 20 inside the bolt guide 3.

Below the contact surface 7, the bolt guide 3 has a groove 26 in which a sensor element 17 is inserted. The sensor element 17 consists of a sensor holder 25 and at least one sensor.

In the example shown in FIG. 4*a*, the sensor element 17 is held in the groove 26 due to the effect of a clamping force. The clamping force is achieved by the horseshoe-shaped design of the sensor element 17, wherein the sensor element 17 is pushed onto the bolt guide in the area of the annular groove 26.

When the operating knob 23 with the accommodated magnet 12 is now moved in arrow direction 14 in the direction of the contact surface 7, the sensor detects this approach as a measured variable and forms an electrical, pneumatic or hydraulic signal, which can be processed further, and which can be evaluated. As shown in FIG. 4*b*, the contact of the operating knob 23 in particular can be determined and monitored with its underside 24 on the contact surface 7. Thus FIG. 4*b* shows the end position of the locking bolt when the distance 13 in FIG. 4*a* amounts to zero.

Figure 5B:
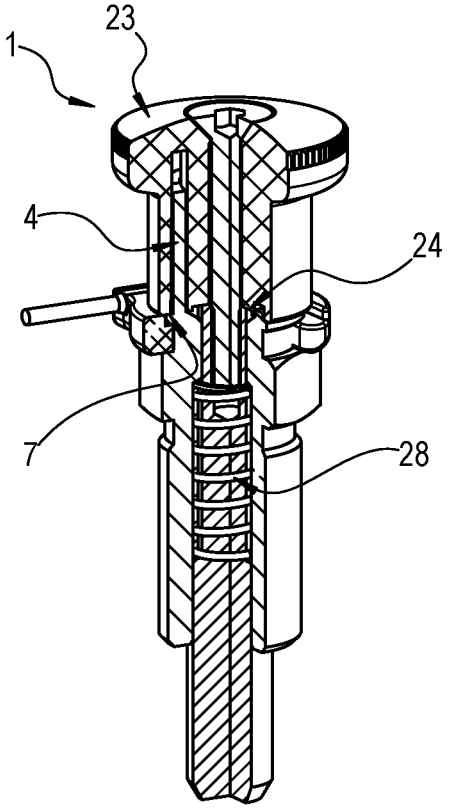
FIGS. 5*a*, 5*b*: a perspective sectional view of a locking bolt (1st embodiment)
Figure 5A:
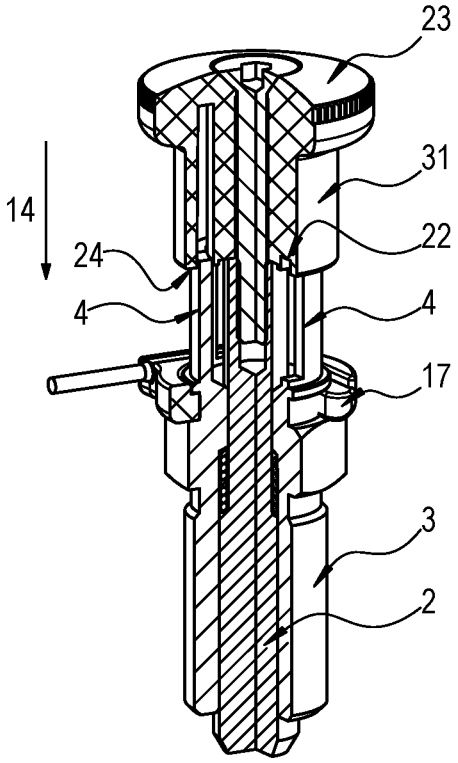

FIGS. 5*a* and 5*b* show the locking bolt according to FIGS. 4*a* and 4*b*, with a locking catch 4 drawn in.

The locking catch 4 is used to temporarily or permanently lock the operating knob 23 in a specific end position (unlocking position). When the bolt 2 is pulled out of the bolt guide 3 against the direction of the arrow 14, the knob 23 can lie with its underside 24 on the end face of the sleeve-shaped locking catch 4. For this purpose, the knob 23 has at least one shoulder 22, which interrupts section by section a cylindrical space 30. As shown in FIG. 5*b*, the receiving space 30 is used to accommodate the sleeve-shaped locking catch 4 when the underside of the operating knob 23 is located on the contact surface 7.

The position of the operating knob 23 shown, in which the shoulder 22 rests on the sleeve-shaped locking catch, can only be released by moving the head 23 along the axis 5 in opposite direction to the arrow 14. As soon as the shoulder 22 is no longer in contact with the end face of the locking catch 4, the knob 23 can be turned about the axis 5, for example by 90°, until the shoulder 22 reaches a slot in the wall of the sleeve-shaped locking catch 4. The slot accommodates the shoulder 22, while the locking catch can be inserted into the receiving space 30.

Figure 6:
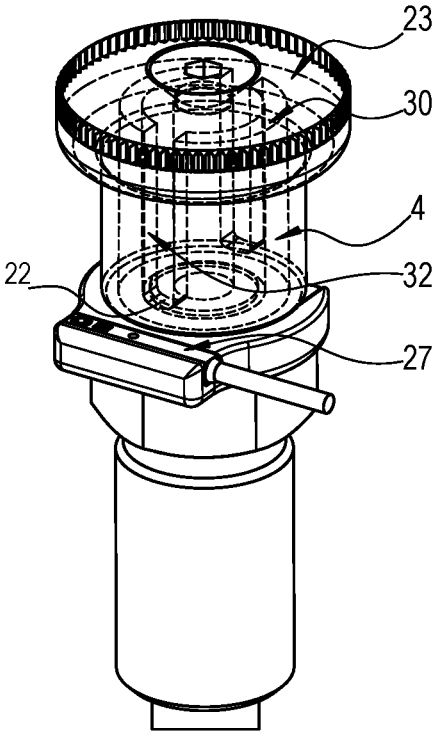
FIG. 6: a perspective sectional view of a locking bolt (2nd embodiment)

As a result, the knob 23 can be moved again in arrow direction 14 in the direction of the front contact surface 7 of the bolt guide 3, as shown in FIG. 5*b*. This is supported by the spring 28, which acts as a return spring. According to FIG. 5*b*, the locking bolt 1 is in an unconfirmed position. FIG. 6 shows the locking bolt in a perspective view in accordance with FIG. 3. In this position, the slot 32 in the wall of the sleeve-shaped locking catch 4 has accommodated the shoulder 22 of the operating knob, and the locking catch 4 is inserted in the receiving space 30. The sensor 27 used here is a magnetic field sensor and the operating knob is magnetic.

Figure 7B:
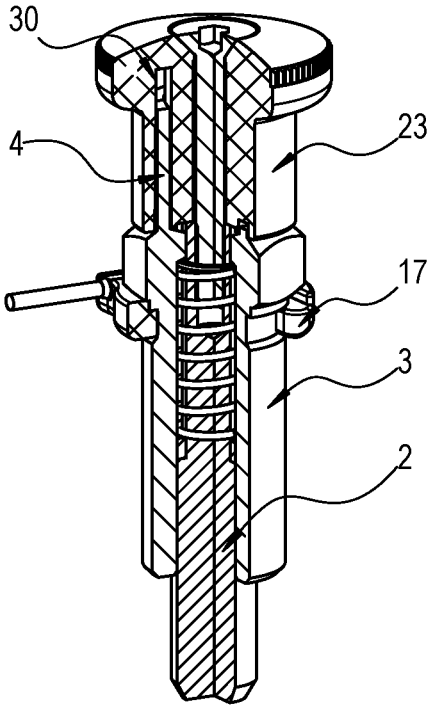
FIGS. 7*a*, 7*b*: a perspective sectional view of a locking bolt (3rd embodiment)
Figure 7A:
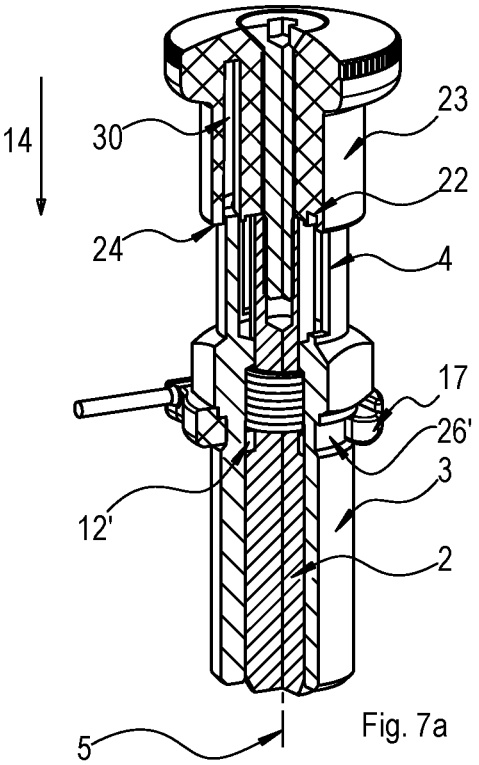

FIG. 7*a* shows a perspective view of the embodiment shown in FIG. 3, in which the sensor element 17 is located in the groove 26', which is arranged in the central area of the sleeve-like bolt guide 3. The magnet 12' for determining the position of bolt 2 is no longer located in the knob 23 but is mounted directly on the outer circumference of the bolt 2, in the interior of the bolt guide 3.

The magnet 12' rests on a ring shoulder 21 of the bolt 2 and can thus be moved together with the bolt 2 in the axial direction inside the bolt guide 3.

If now the magnet 12' is moved to the sensor element 17, it detects the position of the magnet and can determine the current or unlocked or withdrawn/unlocked position of the bolt 2.

The locking bolt 1 has a locking catch 4 in order to temporarily or permanently fix the operating knob 23 in a specific end position (unlocking position).

When the bolt 2 is pulled out of the bolt guide 3 against the direction of the arrow 14, the knob 23 with its underside 24 can lie on the end face of the sleeve-shaped locking catch 4. For this purpose, the knob 23 has at least one shoulder 22, which interrupts section by section a cylindrical receiving space 30. The receiving space 30 is used to accommodate the sleeve-shaped locking catch 4 when the underside of the operating knob 23 is located on the contact surface 7, as shown in FIG. 7*b*.

The position of the operating knob 23 shown, in which the shoulder 22 rests on the sleeve-shaped locking catch, can only be released by moving the head 23 along the axis 5 in opposite direction of the arrow 14. As soon as the shoulder 22 is no longer in contact with the end face of the locking catch 4, the knob 23 can be turned about the axis 5 until the shoulder 22 reaches a slot in the wall of the sleeve-shaped locking catch 4. The slot accommodates the shoulder 22, while the locking catch can be inserted into the receiving space 30.

Thus, the knob 23 can be moved again in arrow direction 14 in the direction of the front contact surface 7 of the bolt guide 3 until it assumes the end position according to FIG. 7*b*.

This present disclosure also claims locking bolts without the locking catch shown in the figures.

The invention claimed is:

1. A manually operated locking bolt having a cylindrical, sleeve-shaped bolt guide and a bolt, which is mounted to be axially displaced in the bolt guide and which has a locking end and an actuating end with an actuator, wherein the bolt is mounted to be axially displaced and locked between a first axial end position and a second axial end position within the bolt guide, wherein at least one sensor is fastened to the bolt guide, which sensor detects the two axial end positions of the bolt, by means of a permanent magnet entrained with the bolt, as a measured variable and generates therefrom at least one of an electrical, pneumatic or hydraulic signal, wherein the permanent magnet is fixed one of in and on the actuator, wherein the at least one sensor comprises at least one magnetically switchable sensor associated opposite the permanent magnet on an upper end face of the bolt guide, further comprising a sleeve-shaped locking catch, the actuator resting with its underside on an end face of a sleeve-shaped locking catch when the locking bolt maintains the first axial end position.

2. The locking bolt according to claim 1, wherein the at least one sensor is at least one of an inductive and a capacitive sensor.

3. The locking bolt according to claim 1, wherein the permanent magnet is fastened to the actuating end of the bolt, a magnetic field of the approaching permanent magnet is detected by the magnetically switchable sensor that is located at the upper end face of the bolt guide, so that the magnetically switchable sensor reacts and generates a signal that indicates the locking position of the bolt.

4. The locking bolt according to claim 1, wherein the permanent magnet is integrated into an underside the actuator at the actuating end of the bolt.

5. The locking bolt according to claim 1, wherein the actuator is magnetized in a permanently magnetic manner at the actuating end of the bolt to form the permanent magnet.

6. The locking bolt according to claim 5, wherein the actuator comprises an operating knob that is at least partially formed from a magnetic material to form the permanent magnet and is produced in a sintering process and/or an injection molding process.

7. The locking bolt according to claim 1, wherein the at least one sensor is embedded in a sensor holder, which surrounds the bolt guide at least partially in an annular manner.

8. The locking bolt according to claim 1, wherein the at least one sensor is fastened in a ring-shaped sensor holder in an area of an annular groove.

9. The locking bolt of claim 4, wherein the permanent magnet comprises a ring-shaped magnet.

10. The locking bolt of claim 4, wherein the permanent magnet comprises a segment.

11. The locking bolt according to claim 2, wherein the actuator is magnetized in a permanently magnetic manner at the actuating end of the bolt to form the permanent magnet.

12. The locking bolt according to claim 2, wherein the at least one sensor is embedded in a sensor holder, which surrounds the bolt guide at least partially in an annular manner.

13. The locking bolt according to claim 3, wherein the at least one sensor is embedded in a sensor holder, which surrounds the bolt guide at least partially in an annular manner.

14. The locking bolt according to claim 4, wherein the at least one sensor is embedded in a sensor holder, which surrounds the bolt guide at least partially in an annular manner.

15. The locking bolt according to claim 5, wherein the at least one sensor is embedded in a sensor holder, which surrounds the bolt guide at least partially in an annular manner.

16. The locking bolt according to claim 6, wherein the at least one sensor is embedded in a sensor holder, which surrounds the bolt guide at least partially in an annular manner.

17. The locking bolt according to claim 2, wherein the at least one sensor is fastened in a ring-shaped sensor holder in an area of an annular groove.

18. The locking bolt according to claim 1, wherein the actuator comprises a knob.

* * * * *